US012543829B2

(12) United States Patent
Wang et al.

(10) Patent No.: US 12,543,829 B2
(45) Date of Patent: Feb. 10, 2026

(54) SUNSHADE

(71) Applicant: Huizhou Sishun Umbrella Co., Ltd., Huizhou (CN)

(72) Inventors: Dongping Wang, Huizhou (CN); Yinglin Chen, Huizhou (CN)

(73) Assignee: Huizhou Sishun Umbrella Co., Ltd., Huizhou (CN)

( * ) Notice: Subject to any disclaimer, the term of this patent is extended or adjusted under 35 U.S.C. 154(b) by 239 days.

(21) Appl. No.: 18/520,752

(22) Filed: Nov. 28, 2023

(65) Prior Publication Data

US 2024/0090631 A1 Mar. 21, 2024

(30) Foreign Application Priority Data

Nov. 9, 2023 (CN) ..... 202323038525.8

(51) Int. Cl.
*A45B 25/14* (2006.01)
*A45B 19/04* (2006.01)
*A45B 25/16* (2006.01)

(52) U.S. Cl.
CPC ..... *A45B 25/143* (2013.01); *A45B 19/04* (2013.01); *A45B 25/16* (2013.01)

(58) Field of Classification Search
CPC ..... A45B 19/04
See application file for complete search history.

(56) References Cited

U.S. PATENT DOCUMENTS 2,221,288 A * 11/1940 Okun ..... A45B 19/04 135/25.4
2,877,782 A * 3/1959 Zimmermann ..... A45B 25/16 135/23
3,672,381 A * 6/1972 Kida ..... A45B 25/16 135/22
3,811,455 A * 5/1974 Thur ..... A45B 19/04 135/25.4
3,850,188 A * 11/1974 Saito ..... A45B 25/14 135/22
3,989,055 A * 11/1976 Saito ..... A45B 19/10 135/22

(Continued)

FOREIGN PATENT DOCUMENTS

DE 2001843 B1 * 11/1970
DE 2512142 A1 * 10/1976

*Primary Examiner* — David R Dunn
*Assistant Examiner* — Danielle Jackson
(74) *Attorney, Agent, or Firm* — Zhigang Ma

(57) ABSTRACT

The present disclosure provides a sunshade includes a honeycomb component, a first center rod, a second center rod and a locking device. The honeycomb component is connected with several umbrella ribs, and the honeycomb component is configured to control opening and closing of the umbrella ribs. The honeycomb component sleeves the first center rod, and the first center rod is provided with a first through hole. The first center rod sleeves the second center rod, and the second center rod can slidably expand to an extended position or a contracted position within the first through hole. The second central rod is locked at the extended position or the contracted position through the locking device. The sunshade can be used as a golf umbrella, which is very beneficial for a user in outdoor activities or any situation that requires shading and greatly improves the user experience.

11 Claims, 9 Drawing Sheets

(56) References Cited

U.S. PATENT DOCUMENTS

| | | | | |
|---|---|---|---|---|
| 5,460,393 | A * | 10/1995 | Tsai | B62B 1/125 280/655 |
| 7,322,371 | B2 * | 1/2008 | You | A45B 25/22 135/25.4 |
| 2005/0056309 | A1 | 3/2005 | Bree et al. | |
| 2011/0315327 | A1 | 12/2011 | Lin | |
| 2019/0338527 | A1 | 11/2019 | Yamaji et al. | |
| 2023/0047818 | A1 * | 2/2023 | Ma | A45B 19/04 |

* cited by examiner

SUNSHADE

CROSS-REFERENCE TO RELATED APPLICATIONS

The application claims priority of Chinese patent application CN2023230385258, filed on 9 Nov. 2023, which is incorporated herein by reference in its entireties.

TECHNICAL FIELD

The present disclosure relates to the field of umbrellas, and in particular, to a sunshade.

BACKGROUND

Existing sunshades on the current market usually use a single center rod structure. This structure limits the range of application and height adjustment capacity of the sunshades. Generally, the sunshades can only block rainwater or sunlight within a certain height. With increasing demands for sunshades and demands for larger, higher, and more convenient sunshades, it is necessary to provide a sunshade with a retractable center rod, so as to meet the needs of modern life.

SUMMARY

In order to overcome the shortcomings of the prior art, the present disclosure provides a sunshade with a retractable center rod, so as to meet the needs of modern life.

The technical solution adopted by the present disclosure to solve the technical problem is as follows:

A sunshade, including:

a honeycomb component, wherein the honeycomb component is connected with several umbrella ribs, and the honeycomb component is configured to control opening and closing of the umbrella ribs;

a first center rod, wherein the honeycomb component sleeves the first center rod, and the first center rod is provided with a first through hole;

a second center rod, wherein the first center rod sleeves the second center rod, and the second center rod slidably expands to an extended position or a contracted position within the first through hole; and a locking device, wherein the second central rod is locked at the extended position or the contracted position through the locking device.

As the improvement of the present disclosure, the locking device includes a first stop device and a second stop device; the first stop device is arranged on the first center rod; the second stop device is arranged on the second center rod; the first stop device is located below the second stop device; and when the second stop device abuts against the first stop device, the first center rod and the second center rod are located at the extended position.

As the improvement of the present disclosure, the first stop device is a stop sleeve; and the stop sleeve is fixedly connected to a lower end of the first center rod through a rivet.

As the improvement of the present disclosure, the second stop device is an elastic stop device; and the elastic stop device includes a mounting bracket, at least two elastic stop sheets fixed to the mounting bracket, and a third spring located between the elastic stop sheets.

As the improvement of the present disclosure, the second center rod is provided with a second through hole; the mounting bracket is connected to an upper end of the second center rod and is partially located inside the second through hole; a side wall of the second center rod is also provided with at least one opening; and the elastic stop sheets pass through the opening and extend out of the second center rod under the action of an elastic force.

As the improvement of the present disclosure, an inner wall of the lower end of the first center rod is provided with at least one groove; the stop sleeve includes at least one stop bulge; the stop bulge is located below the groove; when the elastic stop sheets slide to the groove, the elastic stop sheets are unfolded and press against the groove under the action of the elastic force, and abut against the stop bulge; and at the moment, the first center rod and the second center rod are located at the extended position.

As the improvement of the present disclosure, the elastic stop sheets are provided with arc parts; and the groove is an arc-shaped groove matched with the elastic stop sheets.

As the improvement of the present disclosure, a first spring is arranged inside the first center rod; and the first spring is fixed at an upper end of the first center rod and resists against a top of the mounting bracket.

As the improvement of the present disclosure, the honeycomb component includes an upper honeycomb fixedly sleeving an upper end of the first central rod and a middle honeycomb movably sleeving the first central rod; a pressure reducing bushing is sleeved between the upper honeycomb and the middle honeycomb; the umbrella ribs include main frames and auxiliary frames; the main frames are hinged with the upper honeycomb; one auxiliary frame is connected between each of the main frames and the middle honeycomb; one end of the auxiliary frame is hinged to a middle part of the main frame; and the other end of the auxiliary frame is hinged to the middle honeycomb.

As the improvement of the present disclosure, the honeycomb component further includes a lower honeycomb movably sleeving the first central rod and located below the middle honeycomb; one pull rod is connected between each of the auxiliary frames and the lower comb; one end of the pull rod is hinged to the auxiliary frame; and the other end of the pull rod is hinged to the lower honeycomb.

As the improvement of the present disclosure, the lower honeycomb is provided with a chamber; a second spring is sleeved between the middle honeycomb and the lower honeycomb; one end of the second spring fixedly resists against a bottom of the middle honeycomb, and the other end of the second spring is connected to the lower honeycomb and is partially located in the chamber; the lower honeycomb is provided with a holding part; and antiskid lines are arranged on an outer circumference of the holding part.

As the improvement of the present disclosure, the sunshade further includes an umbrella head, wherein the umbrella head fixedly sleeves a bottom end of the second center rod; a clamping part is arranged below the holding part; and the clamping part slides to the umbrella head and is connected to the umbrella head through a buckle.

As the improvement of the present disclosure, a minimum inner diameter of the clamping part is less than a minimum inner diameter of the stop sleeve, so that when the clamping part slides towards the umbrella head, the clamping part abuts against the stop sleeve and drives the stop sleeve to be locked to the umbrella head; and at the moment, the first center rod and the second center rod are located at the contracted position.

As the improvement of the present disclosure, the clamping part is a cylindrical bushing; the cylindrical bushing is provided with a circular groove; and a first guide slope is arranged at a bottom end of the clamping part.

As the improvement of the present disclosure, the umbrella head includes a clamping bushing, a button switch, and a handle part; the button switch is connected to the clamping bushing; the clamping bushing is fixed at an upper end of the handle part; the clamping bushing sleeves the second center rod in a spacing manner; and an inner diameter of the clamping bushing is greater than an outer diameter of the clamping part.

As the improvement of the present disclosure, the clamping bushing is provided with a button hole and a button clamping slot; the button switch passes through the button hole and is in clamping fit with the button clamping slot; the button switch sleeves the second center rod; and a minimum inner diameter of the button switch is greater than the outer diameter of the clamping part.

As the improvement of the present disclosure, a third spring is connected between the button switch and an inner wall of the clamping bushing; the third spring has a preset elastic force; the preset elastic force forces the button switch to move towards the button hole, so that the button switch protrudes towards an inner side of the clamping bushing; a second guide slope is arranged at an upper end of the clamping bushing; and when the clamping part slides to the clamping bushing, the button switch sinks into the circular groove under the preset elastic force of the third spring.

As the improvement of the present disclosure, a third guide slope is arranged at an upper end of the button switch; the button switch is connected with a button face; and a shape and size of the button face adapt to the button hole.

As the improvement of the present disclosure, a limiting slot is arranged in the button clamping slot; the limiting slot is provided with a first end surface and a second end surface opposite to the first end surface; a limiting bulge is arranged on a side wall of the button switch; and the limiting bulge is located in the limiting slot.

As the improvement of the present disclosure, when the button switch is pressed to be completely clamped into the button clamping slot, the limiting bulge abuts against the first end surface; and when the clamping part slides to the clamping bushing and the button switch sinks into the circular groove, the limiting bulge abuts against the second end surface.

Beneficial effects of the present disclosure are as follows: The present disclosure provides a sunshade includes a honeycomb component, wherein the honeycomb component is connected with several umbrella ribs, and the honeycomb component is configured to control opening and closing of the umbrella ribs; a first center rod, wherein the honeycomb component sleeves the first center rod, and the first center rod is provided with a first through hole; a second center rod, wherein the first center rod sleeves the second center rod, and the second center rod can slidably expand to an extended position or a contracted position within the first through hole; and a locking device, wherein the second central rod is locked at the extended position or the contracted position through the locking device. The sunshade can achieve the extension and contraction of the center rods through the locking device, so that the sunshade with a limited storage length can provide a feeling of a large space after being opened, and provide a larger shadow area without affecting the line of sight or the freedom of movement. The sunshade can be used as a golf umbrella, which is very beneficial for a user in outdoor activities or any situation that requires shading and greatly improves the user experience.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
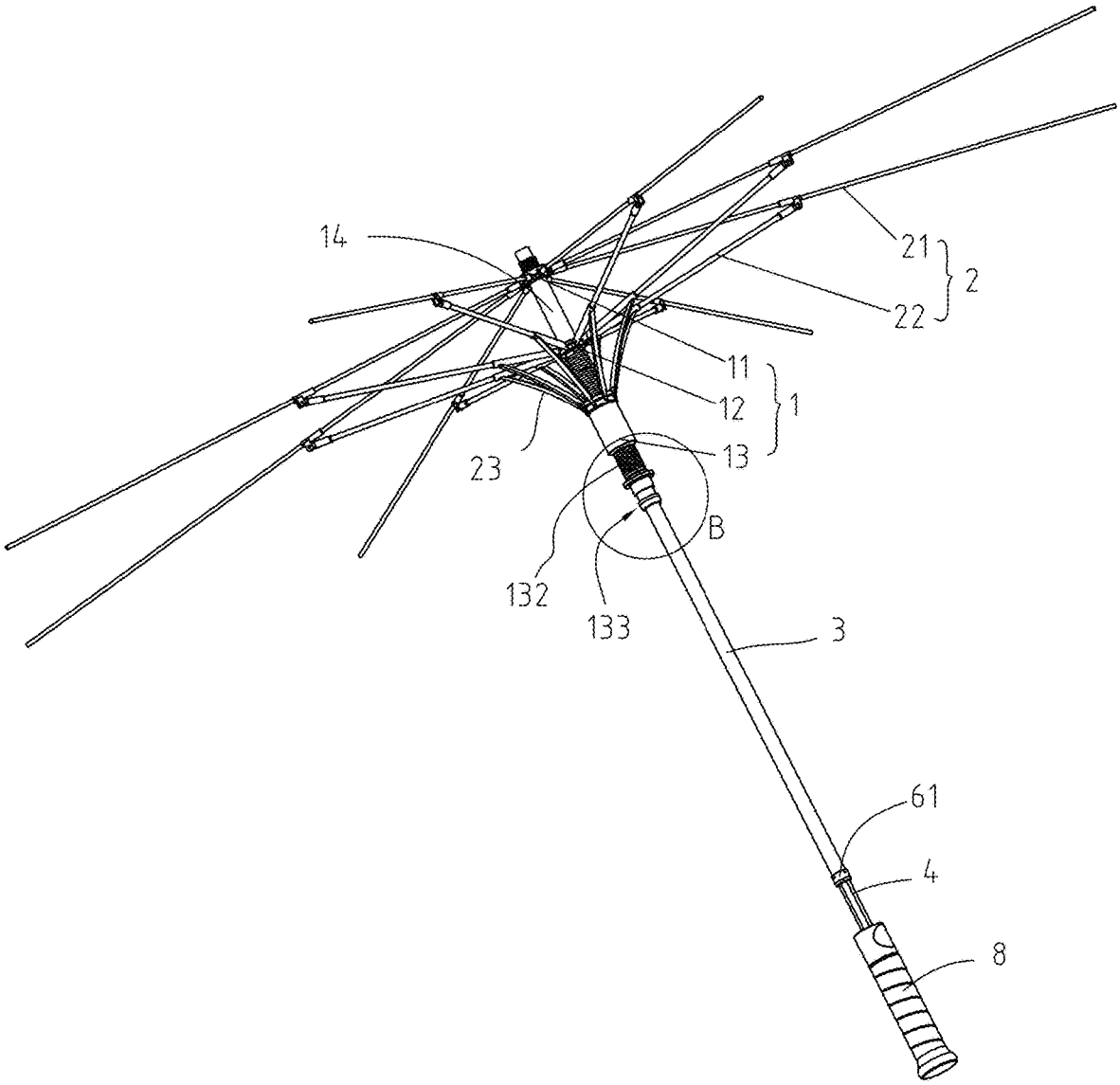
FIG. 1 is a schematic diagram of an entire structure of a sunshade in an opened state according to the present disclosure.
Figure 2:
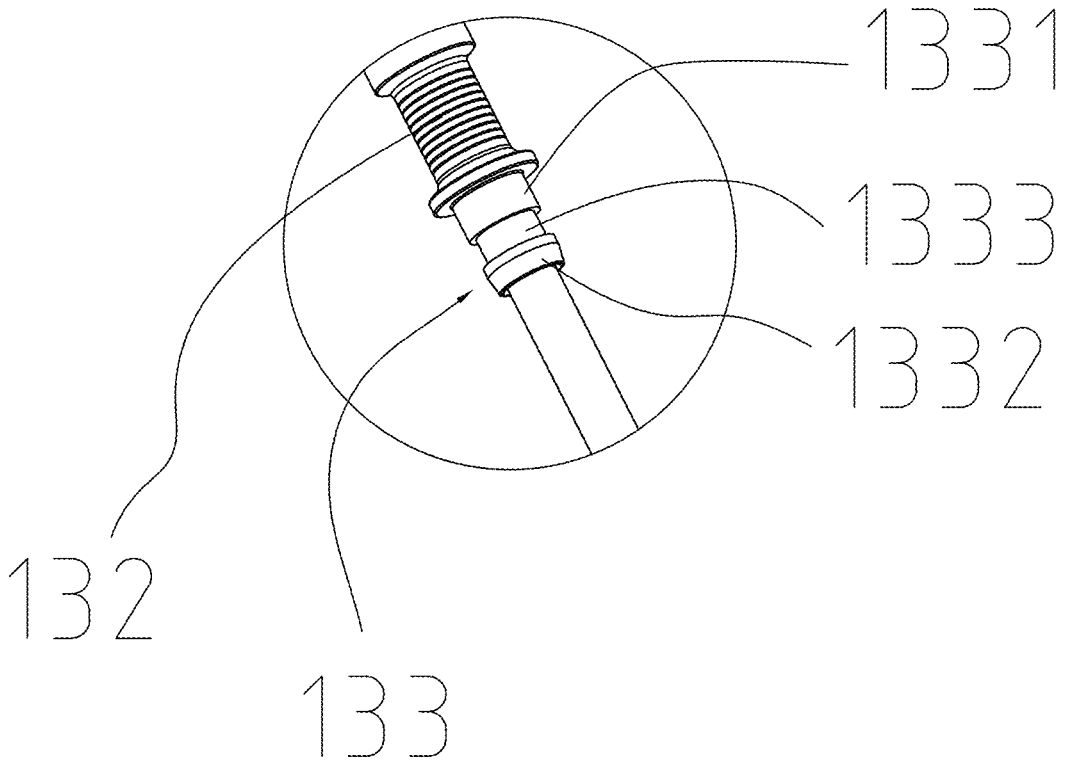
FIG. 2 is an enlarged diagram of a part B in FIG. 1.
Figure 3:
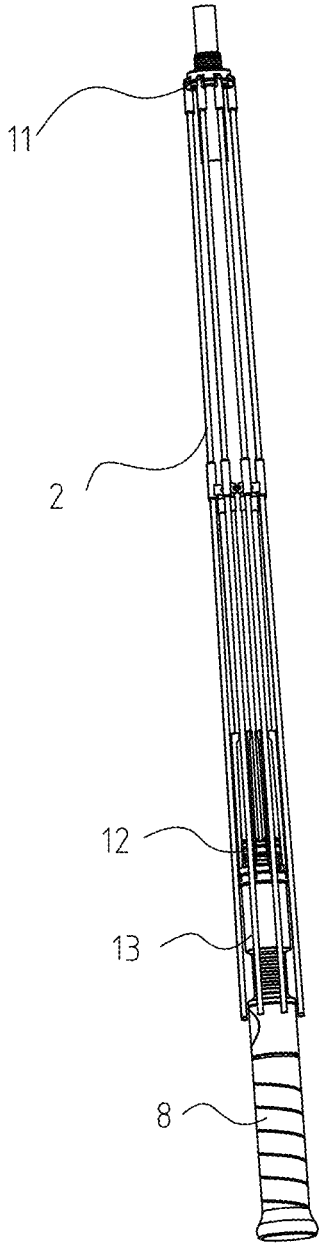
FIG. 3 is a schematic diagram of an entire structure of a closed state according to the present disclosure.
Figure 4:
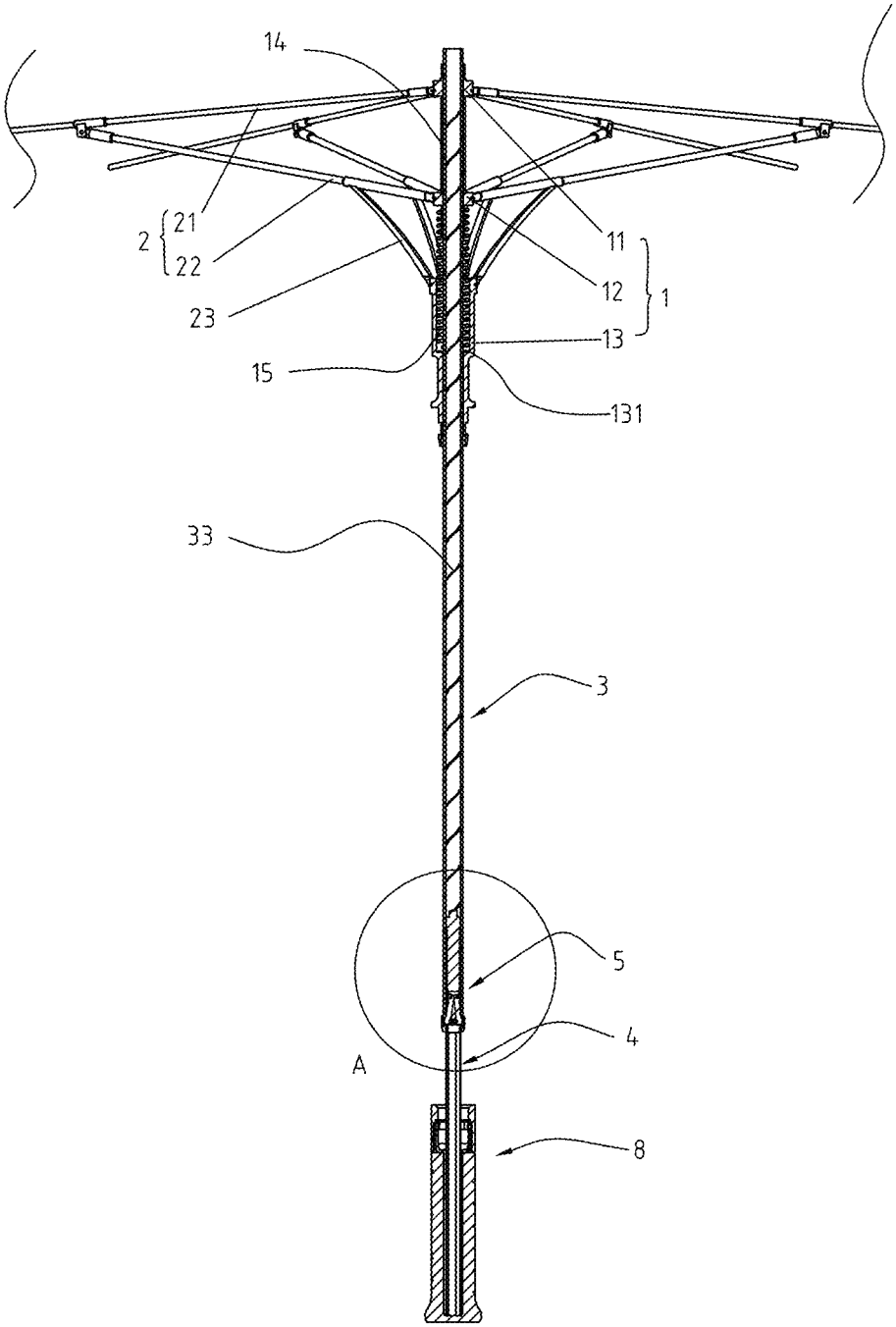
FIG. 4 is a sectional view of a sunshade in an opened state according to the present disclosure.
Figure 5:
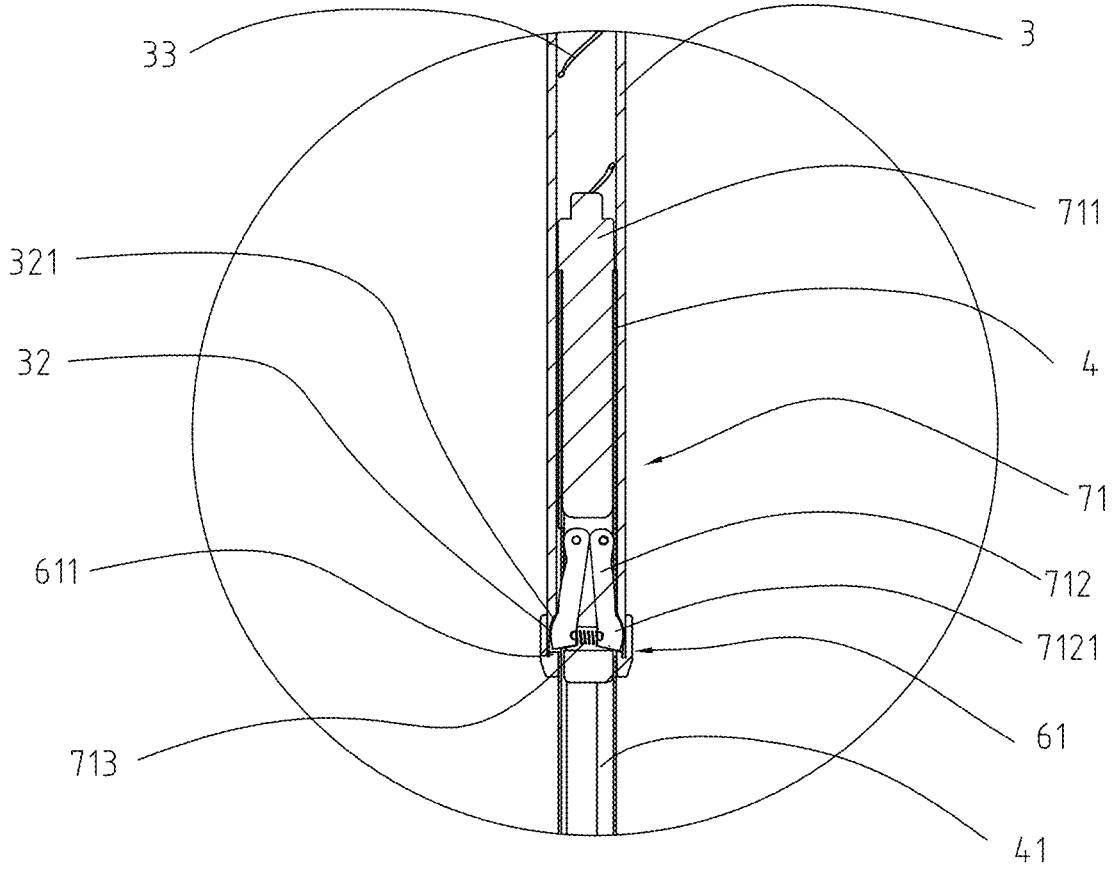
FIG. 5 is an enlarged diagram of a part A in FIG. 4.
Figure 6:
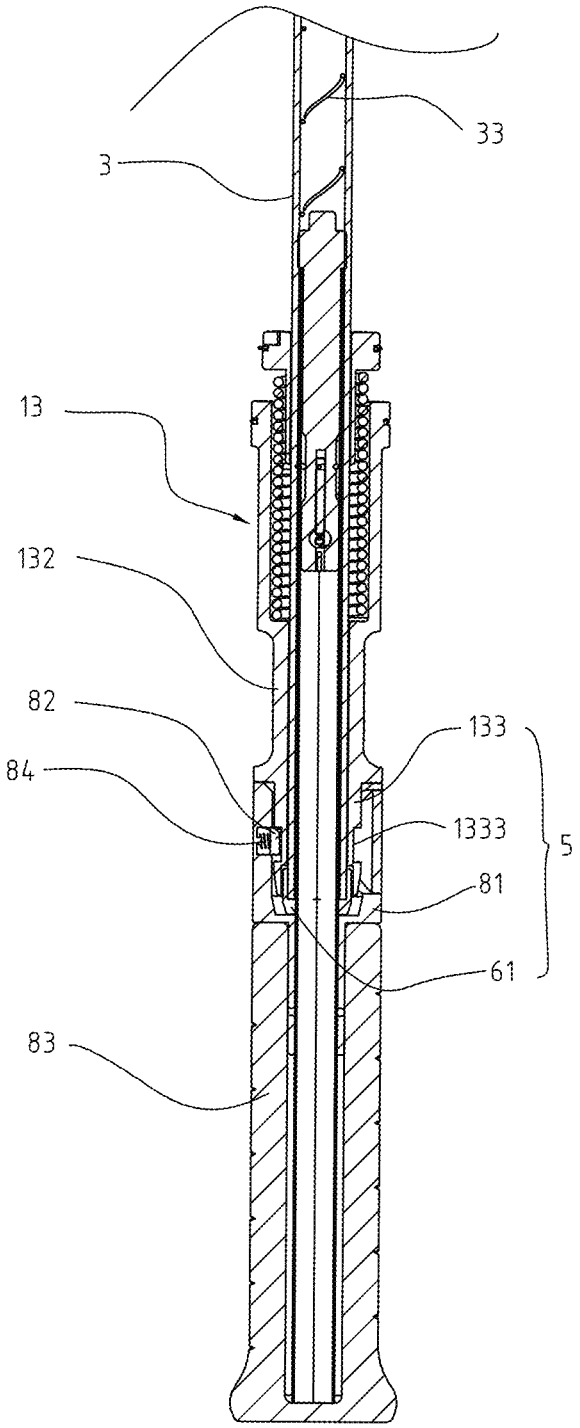
FIG. 6 is a partially sectional view of a sunshade in a closed state according to the present disclosure.
Figure 7:
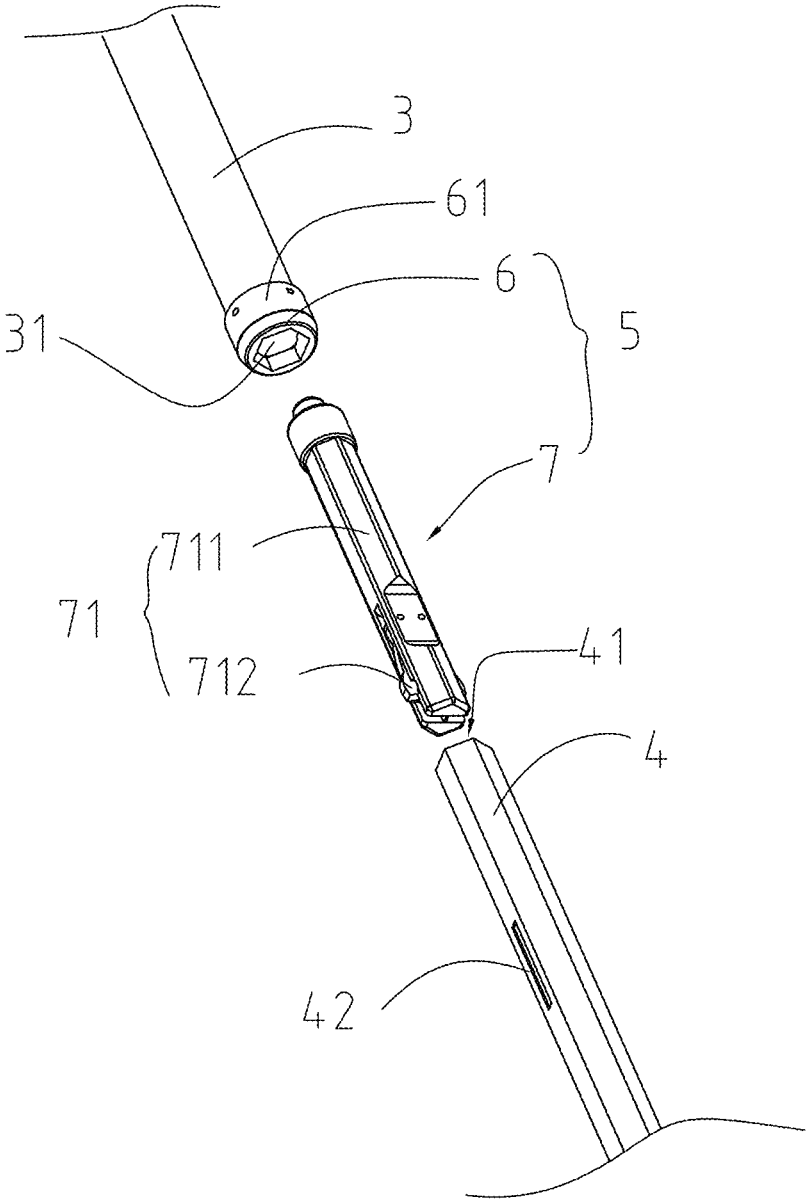
FIG. 7 is a partially exploded view of the present disclosure.
Figure 8:
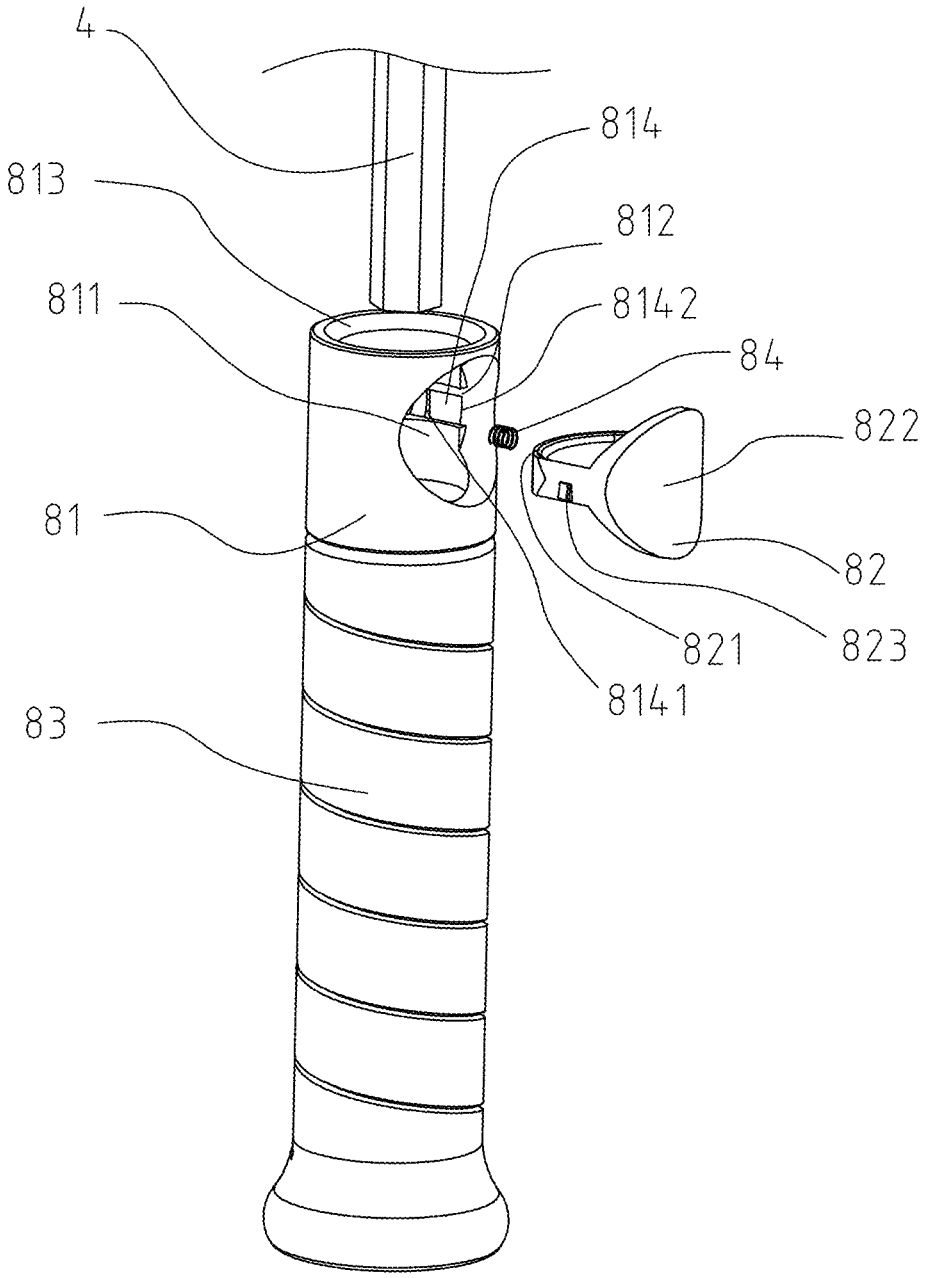
FIG. 8 is another partially exploded view of the present disclosure.
Figure 9:
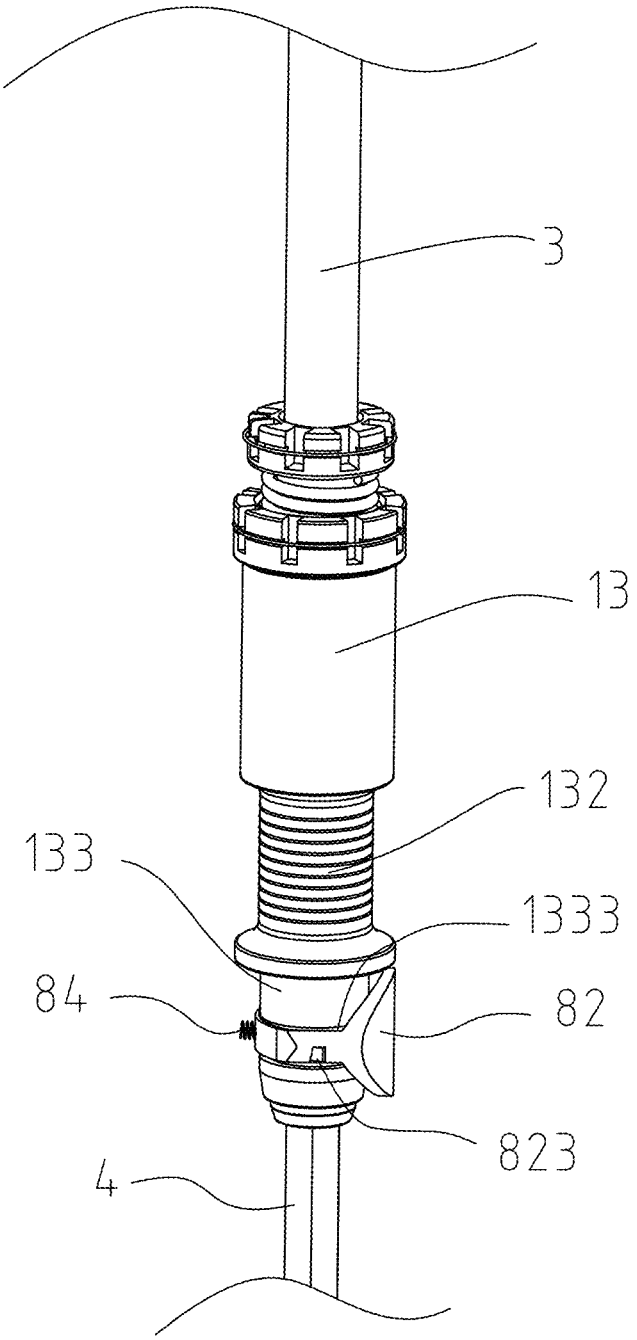
FIG. 9 is a schematic diagram of a partial structure of a closed state according to the present disclosure.

Referring to FIG. 1 to FIG. 5, a sunshade includes a honeycomb component 1, wherein the honeycomb component 1 is connected with several umbrella ribs 2, and the honeycomb component 1 is configured to control opening and closing of the umbrella ribs 2; a first center rod 3, wherein the honeycomb component 1 sleeves the first center rod 3, and the first center rod 3 is provided with a first through hole 31; a second center rod 4, wherein the first center rod 3 sleeves the second center rod 4, and the second center rod 4 can slidably expand to an extended position or a contracted position within the first through hole 31; and a locking device 5, wherein the second central rod 4 is locked at the extended position or the contracted position through the locking device 5. Through the above structure, the sunshade can achieve the extension and contraction of the center rods through the locking device 5, so that the sunshade with a limited storage length can provide a feeling of a large space after being opened, and provide a larger shadow area without affecting the line of sight or the freedom of movement. The sunshade can be used as a golf umbrella, which is very beneficial for a user in outdoor activities or any situation that requires shading and greatly improves the user experience.

In this embodiment, the locking device 5 includes a first stop device 6 and a second stop device 7; the first stop device 6 is arranged on the first center rod 3; the second stop device 7 is arranged on the second center rod 4; the first stop device 6 is located below the second stop device 7; and when the second stop device 7 abuts against the first stop device 6, the first center rod 3 and the second center rod 4 are located at the extended position. Through the above structure, the first stop device 6 abuts against the second stop device 7, which limits separation of the first center rod 3 from the second center rod 4, so that the first center rod 3 and the second center rod 4 are in the extended position, thereby achieving the extension of the center rods of the sunshade.

Preferably, the first stop device 6 is a stop sleeve 61; and the stop sleeve 61 is fixedly connected to a lower end of the first center rod 3 through a rivet. The second stop device 7 is an elastic stop device 71; and the elastic stop device 71 includes a mounting bracket 711, at least two elastic stop sheets 712 fixed to the mounting bracket 711, and a third spring 713 located between the elastic stop sheets. Through the above structure, it is extremely firm to fixedly connect the stop sleeve 61 to the lower end of the first center rod 3 through the rivet, which prevents the risk that the stop sleeve 61 falls off from the first center rod 3 and improves the stability of the extension of the center rods. The elastic stop sheets 712 extend under the elastic force of the third spring 713, which better achieves stable abutment between the elastic stop sheets 712 and the stop sleeve 61 and plays a role in limiting the separation of the first center rod 3 from the second center rod 4.

Specifically, the second center rod 4 is provided with a second through hole 41; the mounting bracket 711 is connected to an upper end of the second center rod 4 and is partially located inside the second through hole 41; a side wall of the second center rod 4 is also provided with at least one opening 42; and the elastic stop sheets 712 can pass through the opening 42 and extends out of the second center rod 4 under the action of an elastic force. An inner wall of the lower end of the first center rod 3 is provided with at least one groove 32; the stop sleeve 61 includes at least one stop bulge 611; the stop bulge 611 is located below the groove 32; when the elastic stop sheets 712 slide to the groove 32, the elastic stop sheets 712 are unfolded and press against the groove 32 under the action of the elastic force, and abut against the stop bulge 611; and at the moment, the first center rod 3 and the second center rod 4 are located at the extended position. Specifically, a quantity of the groove 32 corresponds to a quantity of the elastic stop sheets 712. The quantity of the groove 32 is two, and a quantity of the stop bulge 611 also corresponds to the quantity of the grooves 32 and the quantity of the elastic stop sheets 712, and is also two. Through the above structure, the function of the locking device is effectively achieved. When the elastic stop sheets 712 are unfolded and press against the grooves 32 under the action of the elastic force, and abuts against the stop bulges 611, the first center rod 3 is limited to the second center rod 4, so that the first center rod cannot slide out of the second center rod. At this time, the first center rod 3 and the second center rod 4 are at maximum retractable lengths, so that the sunshade is also at a maximum retractable length.

In this embodiment, the elastic stop sheets 712 are provided with arc parts 7121; and the grooves 32 are arc-shaped grooves 321 matched with the elastic stop sheets 712. Through the above structure, the arc parts 7121 can easily achieve that the elastic stop sheets 712 slide into or out of the arc-shaped grooves 321 inside the first through hole 31, so that a pressing action between the elastic stop sheets 712 and the grooves 32 is better completed.

In this embodiment, a first spring 33 is arranged inside the first center rod 3; and the first spring 33 is fixed at an upper end of the first center rod 3 and resists against a top of the mounting bracket 711. Through the above structure, under the action of the elastic force of the first spring 33, the first center rod 3 and the second center rod 4 move in opposite directions under the pressing of the first spring 33, so that the first center rod 3 and the second center rod 4 have a power trend of extension. The first spring 33 provides a power support for the extension and contraction of the center rods of the sunshade.

In this embodiment, the honeycomb component 1 includes an upper honeycomb 11 fixedly sleeving an upper end of the first central rod 3 and a middle honeycomb 12 movably sleeving the first central rod 3; a pressure reducing bushing 14 is sleeved between the upper honeycomb 11 and the middle honeycomb 12; the umbrella ribs 2 include main frames 21 and auxiliary frames 22; the main frames 21 are hinged with the upper honeycomb 11; one auxiliary frame 22 is connected between each of the main frames 21 and the middle honeycomb 12; one end of the auxiliary frame 22 is hinged to a middle part of the main frame 21; and the other end of the auxiliary frame 22 is hinged to the middle honeycomb 12. The honeycomb component 1 further includes a lower honeycomb 13 movably sleeving the first central rod 3 and located below the middle honeycomb 12; one pull rod 23 is connected between each of the auxiliary frames 22 and the lower honeycomb 13; one end of the pull rod 23 is hinged to the auxiliary frame 22; and the other end of the pull rod 23 is hinged to the lower honeycomb 13, wherein the main frames 21 and the auxiliary frames 22 are unfoldable straight frames.

Specifically, the lower honeycomb 13 is provided with a chamber 131; a second spring 15 is sleeved between the middle honeycomb 12 and the lower honeycomb 13; one end of the second spring 15 fixedly resists against a bottom of the middle honeycomb 12, and the other end of the second spring 15 is connected to the lower honeycomb 13 and is partially located in the chamber 131; the lower honeycomb 13 is provided with a holding part 132; and antiskid lines are arranged on an outer circumference of the holding part 132. Through the above structure, the umbrella ribs 2, the first center rod 3, and the pull rods 23 form a triangular structure. Since the spring is located between the middle honeycomb 12 and the lower honeycomb 13, when the pull rods 23 are pulled downwards, the pull rods 23 drive the umbrella ribs 2 to be closed inwards. At the same time, under the supporting of the auxiliary frames 22, the spring can be easily compressed by virtue of a force arm formed by the umbrella ribs, making it more labor-saving when the sunshade is closed. When the sunshade is opened, the pressure reducing bushing 14 is arranged between the upper honeycomb 11 and the middle honeycomb 12, which reduces an impact force on an umbrella framework. Therefore, a good protecting role can be played on the umbrella framework, and the service life of the umbrella framework is prolonged. The design scheme of the honeycomb component 1 effectively improves the stability and reliability of the overall structure of a folding golf umbrella. Furthermore, the lower honeycomb 13 is provided with the holding part 132 with the antiskid lines, which increases a friction force when the user holds the holding part 132 with a hand, making it more convenient and labor-saving for the user to control the opening and closing of the sunshade.

In this embodiment, the sunshade further includes an umbrella head 8; the umbrella head 8 fixedly sleeves a bottom end of the second center rod 4; a clamping part 133 is arranged below the holding part 132; and the clamping part 133 can slide to the umbrella head 8 and is connected to the umbrella head 8 through a buckle. Through the above structure, the closing action of the sunshade is effectively achieved. When the clamping part 133 slides to the umbrella head 8 and is connected to the umbrella head 8 through the buckle, the sunshade is in a folded and closed state.

In this embodiment, a minimum inner diameter of the clamping part 133 is less than a minimum inner diameter of the stop sleeve 61, so that when the clamping part 133 slides towards the umbrella head 8, the clamping part abuts against the stop sleeve 61 and drives the stop sleeve 61 to be locked to the umbrella head 8; and at the moment, the first center rod 3 and the second center rod 4 are located at the contracted position. Through the above structure, the clamping part 133, the stop sleeve 61, and the buckle structure in the umbrella head 8 are included in the locking device 5. This behavior effectively locks the first center rod 3 and the second center rod 4 at the contracted position.

In this embodiment, the clamping part 133 is a cylindrical bushing 1331; the cylindrical bushing 1331 is provided with a circular groove 1333; and a first guide slope 1332 is arranged at a bottom end of the clamping part 133. Through the above structure, due to the cylindrical clamping part 133, when the user needs to open or close the sunshade, the non-directional circular shape facilitates the user to easily open and close the sunshade, which not only increases the stability and safety of the sunshade, but also improves the user experience.

In this embodiment, the umbrella head 8 includes a clamping bushing 81, a button switch 82, and a handle part 83; the button switch 82 is connected to the clamping bushing 81; the clamping bushing 81 is fixed at an upper end of the handle part 83; the clamping bushing 81 sleeves the second center rod 4 in a spacing manner; and an inner diameter of the clamping bushing 81 is greater than an outer diameter of the clamping part 133. Specifically, the clamping bushing 81 is provided with a button hole 811 and a button clamping slot 812; the button switch 82 can pass through the button hole 811 and is in clamping fit with the button clamping slot 812; the button switch 82 sleeves the second center rod 4; and a minimum inner diameter of the button switch 82 is greater than the outer diameter of the clamping part 133.

Further, a third spring 84 is connected between the button switch 82 and an inner wall of the clamping bushing 81; the third spring 84 has a preset elastic force; the preset elastic force forces the button switch 82 to move towards the button hole 811, so that the button switch 82 protrudes towards an inner side of the clamping bushing 81; a second guide slope 813 is arranged at an upper end of of the clamping bushing 81; and when the clamping part 133 slides to the clamping bushing 81, the button switch 82 sinks into the circular groove 1333 under the preset elastic force of the third spring 84. A third guide slope 821 is arranged at an upper end of the button switch 82; the button switch 82 is connected with a button face 822; and a shape and size of the button face 822 adapt to the button hole 811. Through the above structure, the design of the buckle structure in the umbrella head 8 effectively achieves that the sunshade is in a working or a non-working state, and the design of the guide slope also facilitates the clamping part 81133 to slide from the first center rod 3 to the clamping bushing 81 and lock the clamping part with the buckle. This design is simple and practical.

In this embodiment, a limiting slot 814 is arranged in the button clamping slot 812; the limiting slot 814 is provided with a first end surface 8141 and a second end surface 8142 opposite to the first end surface 8141; a limiting bulge 823 is arranged on a side wall of the button switch 82; and the limiting bulge 823 is located in the limiting slot. When the button switch 82 is pressed to be completely clamped into the button clamping slot 812, the limiting bulge 823 abuts against the first end surface 8141; and when the clamping part 133 slides to the clamping bushing 81 and the button switch 82 sinks into the circular groove 1333, the limiting bulge 823 abuts against the second end surface 8142. Through the above structure, the design of cooperation and abutment between the limiting slot 814 and the limiting bulge 823 ensures that the button switch 82 is in an optimal working state, and is not prone to failure of a function caused by sliding off. This ensures the stability and reliability of the sunshade during opening and closing.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A sunshade, comprising:

a honeycomb component, wherein the honeycomb component is connected with several umbrella ribs, and the honeycomb component is configured to control opening and closing of the umbrella ribs;

a first center rod, wherein the honeycomb component sleeves the first center rod, and the first center rod is provided with a first through hole;

a second center rod, wherein the first center rod sleeves the second center rod, and the second center rod slidably expands to an extended position or a contracted position within the first through hole; and a locking device, wherein the second central rod is locked at the extended position or the contracted position through the locking device;

wherein the locking device comprises a first stop device and a second stop device; the first stop device is arranged on the first center rod; the second stop device is arranged on the second center rod; the first stop device is located below the second stop device; and when the second stop device abuts against the first stop device, the first center rod and the second center rod are located at the extended position;

wherein the first stop device is a stop sleeve; and the stop sleeve is fixedly connected to a lower end of the first center rod through a rivet;

wherein the second stop device is an elastic stop device; and the elastic stop device comprises a mounting bracket, at least two elastic stop sheets fixed to the mounting bracket, and a third spring located between the elastic stop sheets;

wherein the second center rod is provided with a second through hole; the mounting bracket is connected to an upper end of the second center rod and is partially located inside the second through hole; a side wall of the second center rod is also provided with at least one opening; and the elastic stop sheets pass through the opening and extend out of the second center rod under the action of an elastic force;

wherein an inner wall of the lower end of the first center rod is provided with at least one groove; the stop sleeve comprises at least one stop bulge; the stop bulge is located below the groove; when the elastic stop sheets slide to the groove, the elastic stop sheets are unfolded and press against the groove under the action of the elastic force, and abut against the stop bulge; and at the moment, the first center rod and the second center rod are located at the extended position.

2. The sunshade according to claim 1, wherein the elastic stop sheets are provided with arc parts; and the groove is an arc-shaped groove matched with the elastic stop sheets.

3. The sunshade according to claim 1, wherein a first spring is arranged inside the first center rod; and the first spring is fixed at an upper end of the first center rod and abuts against a top of the mounting bracket.

4. A sunshade, comprising:

a honeycomb component, wherein the honeycomb component is connected with several umbrella ribs, and the honeycomb component is configured to control opening and closing of the umbrella ribs;

a first center rod, wherein the honeycomb component sleeves the first center rod, and the first center rod is provided with a first through hole;

a second center rod, wherein the first center rod sleeves the second center rod, and the second center rod slidably expands to an extended position or a contracted position within the first through hole; and a locking device, wherein the second central rod is locked at the extended position or the contracted position through the locking device;

wherein the honeycomb component comprises an upper honeycomb fixedly sleeving an upper end of the first central rod and a middle honeycomb movably sleeving the first central rod; a pressure reducing bushing is sleeved between the upper honeycomb and the middle honeycomb; the umbrella ribs comprise main frames and auxiliary frames; the main frames are hinged with the upper honeycomb; one auxiliary frame is connected between each of the main frames and the middle honeycomb; one end of the auxiliary frame is hinged to a middle part of the main frame; and the other end of the auxiliary frame is hinged to the middle honeycomb;

wherein the honeycomb component further comprises a lower honeycomb movably sleeving the first central rod and located below the middle honeycomb; one pull rod is connected between each of the auxiliary frames and the lower honeycomb; one end of the pull rod is hinged to the auxiliary frame; and the other end of the pull rod is hinged to the lower honeycomb;

wherein the lower honeycomb is provided with a chamber; a second spring is sleeved between the middle honeycomb and the lower honeycomb; one end of the second spring fixedly abuts against a bottom of the middle honeycomb, and the other end of the second spring is connected to the lower honeycomb and is partially located in the chamber; the lower honeycomb is provided with a holding part; and antiskid lines are arranged on an outer circumference of the holding part;

wherein the sunshade further comprises an umbrella head, the umbrella head fixedly sleeves a bottom end of the second center rod; a clamping part is arranged below the holding part; and the clamping part slides to the umbrella head and is connected to the umbrella head through a buckle;

wherein a minimum inner diameter of the clamping part is less than a minimum inner diameter of the stop sleeve, so that when the clamping part slides towards the umbrella head, the clamping part abuts against the stop sleeve and drives the stop sleeve to be locked to the umbrella head; and at the moment, the first center rod and the second center rod are located at the contracted position.

5. The sunshade according to claim 4, wherein the clamping part is a cylindrical bushing; the cylindrical bushing is provided with a circular groove; and a first guide slope is arranged at a bottom end of the clamping part.

6. The sunshade according to claim 5, wherein the umbrella head comprises a clamping bushing, a button switch, and a handle part; the button switch is connected to the clamping bushing; the clamping bushing is fixed at an upper end of the handle part; the clamping bushing sleeves the second center rod in a spacing manner; and an inner diameter of the clamping bushing is greater than an outer diameter of the clamping part.

7. The sunshade according to claim 6, wherein the clamping bushing is provided with a button hole and a button clamping slot; the button switch passes through the button hole and is in clamping fit with the button clamping slot; the button switch sleeves the second center rod; and a minimum inner diameter of the button switch is greater than the outer diameter of the clamping part.

8. The sunshade according to claim 7, wherein a third spring is connected between the button switch and an inner wall of the clamping bushing; the third spring has a preset elastic force; the preset elastic force forces the button switch to move towards the button hole, so that the button switch protrudes towards an outer side of the clamping bushing; a second guide slope is arranged at an upper end of the clamping bushing; and when the clamping part slides to the clamping bushing, the button switch sinks into the circular groove under the preset elastic force of the third spring.

9. The sunshade according to claim 8, wherein a third guide slope is arranged at an upper end of the button switch; the button switch is connected with a button face; and a shape and size of the button face are configured to be accommodated in the button hole.

10. The sunshade according to claim 9, wherein a limiting slot is arranged in the button clamping slot; the limiting slot is provided with a first end surface and a second end surface opposite to the first end surface; a limiting bulge is arranged on a side wall of the button switch; and the limiting bulge is located in the limiting slot.

11. The sunshade according to claim 10, wherein when the button switch is pressed to be completely clamped into the button clamping slot, the limiting bulge abuts against the first end surface; and when the clamping part slides to the clamping bushing and the button switch sinks into the circular groove, the limiting bulge abuts against the second end surface.

* * * * *